US005934300A

United States Patent [19]

Breton

[11] Patent Number: 5,934,300

[45] Date of Patent: Aug. 10, 1999

[54] CANE FOR VISUALLY HANDICAPPED

[76] Inventor: James L. Breton, 55 Boyles St., Beverly, Mass. 01915

[21] Appl. No.: 08/910,951

[22] Filed: Aug. 8, 1997

[51] Int. Cl.[6] ..... A61H 3/06

[52] U.S. Cl. ..... 135/65; 135/72; 135/77; 135/911

[58] Field of Search ..... 135/65, 66, 71, 135/72, 73, 75, 76, 77, 81, 911

[56] References Cited

U.S. PATENT DOCUMENTS

| | | | |
|---|---|---|---|
| 1,527,239 | 12/1925 | Vaughn et al. . | |
| 1,556,966 | 10/1925 | Selig | 135/77 X |
| 1,663,622 | 3/1928 | Atkinson | 135/82 |
| 2,379,426 | 7/1945 | Edstrom . | |
| 2,409,365 | 10/1946 | Lamb | 135/71 |
| 4,111,444 | 9/1978 | Clements, Jr. | 135/66 X |
| 5,197,501 | 3/1993 | Ragatz | 135/66 |
| 5,301,703 | 4/1994 | Kahn . | |
| 5,485,862 | 1/1996 | Kahn . | |

FOREIGN PATENT DOCUMENTS

| | | | |
|---|---|---|---|
| 2375843 | 9/1978 | France | 135/66 |
| 3212723 | 10/1983 | Germany | 135/911 |

OTHER PUBLICATIONS

AMBU Tech "Superior Mobility Products" catalogue 1995.

*Primary Examiner*—Carl D. Friedman
*Assistant Examiner*—Winnie S. Yip
*Attorney, Agent, or Firm*—Don Halgren

[57] ABSTRACT

The present invention comprises a cane assembly for the visually handicapped, to permit maximum tactile and auditory information between terrain touched by said cane assembly and a user thereof. The cane assembly includes a tapered metal cane shaft having an upper or proximalmost end and a lower or distalmost end. A metal handle with a finger groove is secured to the upper end of the shaft and a solid elliptically shaped plastic tip is secured to the lowermost tip of the shaft. The elliptically shaped solid attachable tip permits the cane assembly to provide superior touch and sound from all terrain encountered, without the likelihood of snagging on a crack or the like.

12 Claims, 2 Drawing Sheets

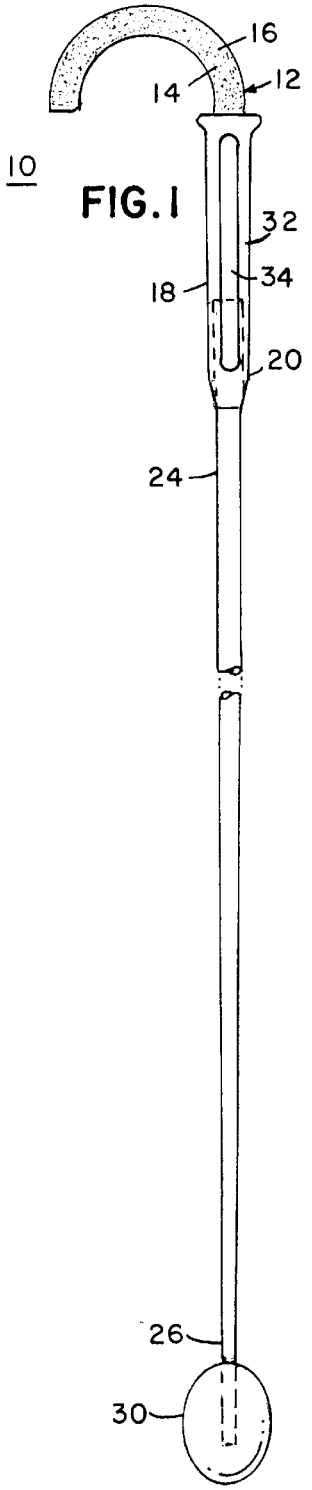
FIG. 1
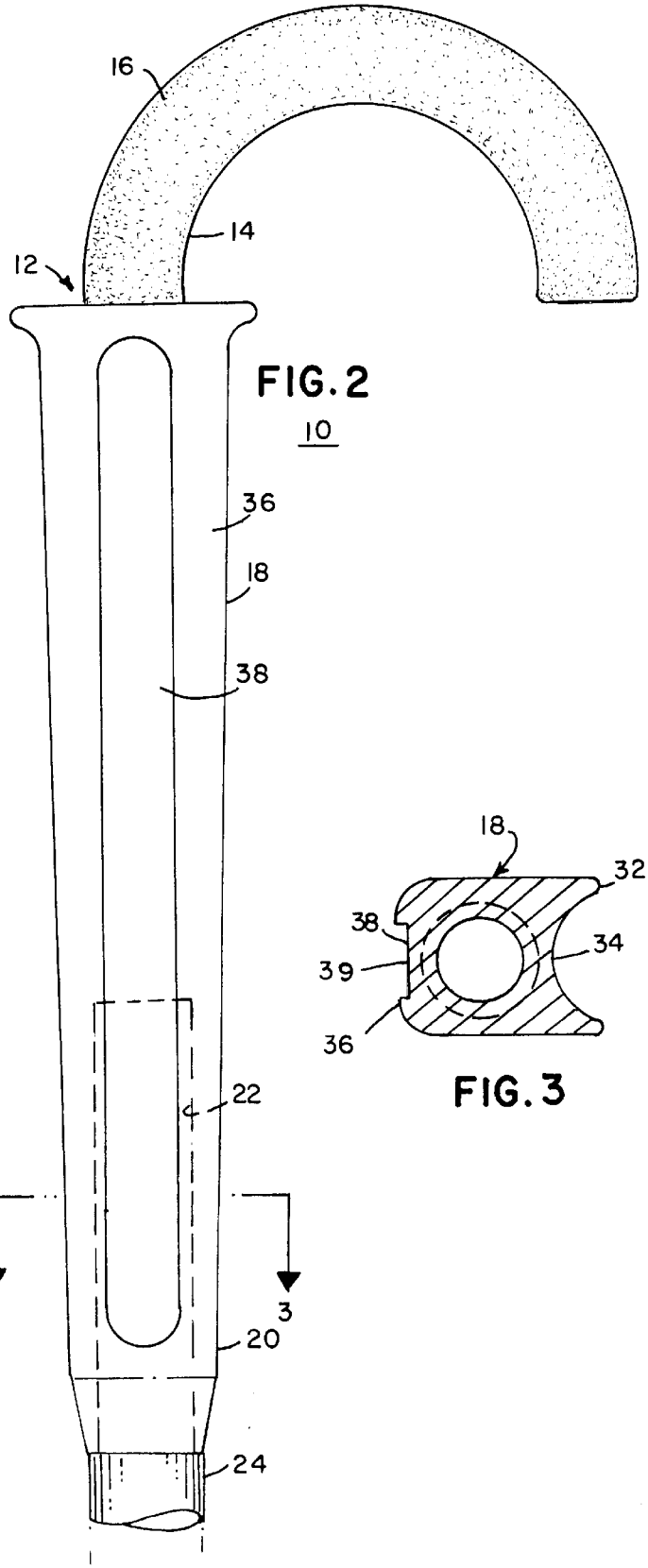
FIG. 2
FIG. 3

CANE FOR VISUALLY HANDICAPPED

BACKGROUND OF THE INVENTION

1. Field of the Invention

This invention relates to canes, and more particularly walking canes for the visually disabled.

2. Prior Art

Blind or visually handicapped people walk with a cane to enable them to sense an obstacle or a potentially dangerous condition before them. Typically, a cane user swings the cane from side to side. The cane may also be tapped against the ground as the user swings the cane back and forth.

The tapping permits the user to appreciate through sound and tactile response, what sort of terrain is being traversed. The cane must not be designed so as to allow it to get caught in a crack in a sidewalk or stuck in some sort of an obstacle. The tips of these canes need to be replaced on a regular basis because they wear out. The tips of these canes also need to provide accurate information to the user as clearly and efficiently as possible.

Some canes for the visually handicapped have distal tips which may have wheels thereon. Such canes are shown in U.S. Pat. No. 1,527,239 to Vaughan et al. and U.S. Pat. No. 2,379,426 to Edstrom. Use of such wheels however, may dampen the response that a user may get by having a cane tip which actually strikes and rubs against the terrain.

Other cane arrangements, are shown in U.S. Pat. No. 5,301,703 to Kahn, wherein the cane includes a hemispherical shell at its distalmost end. A further patent to Kahn, is shown in U.S. Pat. No. 5,485,862, disclosing a cane with a spherical tip which tip is separable along its equator, for splitting the sphere into a lower hemisphere and an upper hemisphere.

The prior art appears replete with cane tips of a circular or spherical configuration.

It is an object of the present invention, to provide a cane assembly which will maximize the audible end tactile response to a user thereof.

It is yet a further object of the present invention, to provide a cane assembly having an improved distalmost tip to maximize the contact area between the tip and the terrain.

It is still yet a further object of the present invention, to provide a cane handle which will maximize the sensory transmission between the cane and the hand of the user.

BRIEF SUMMARY OF THE INVENTION

The present invention comprises a novel cane assembly to be utilized by a visually handicapped individual. The cane assembly comprises an upper or proximalmost end having a curved or J-shaped handle. The end portion of the handle is preferably a soft sponge covering fitted onto a rigid metal, plastic or wood core. The J-shaped handle mates with a handle engagement housing. The handle engagement housing is preferably made of metal for transmission of tactile feedback and has a lower or distalmost end with a bore therewithin. The bore is arranged to receive the proximalmost end of a metal shaft, the shaft being made to tapering dimensions, the shaft becoming narrower at its distalmost end. The proximalmost end of the shaft mates within the bore in the lower or distalmost end of the handle engagement housing in a tight fitting manner.

The distalmost end of the tapered shaft, has an elliptically shaped solid plastic tip mated thereon. The elliptical shape of the tip provides a greater arc length of terrain contact than does a hemispherically or spherically shaped tip. This shape of the replaceable tip is important for maximizing tactile feedback to the user.

The handle engagement housing is elongated, and is of generally square-shape in cross-section. The handle engagement housing has a first side with an elongated channel or groove arranged therein. The elongated handle engagement housing has an opposing second side with a shallow depression therewithin.

The channel or groove on the first side of the handle engagement housing is arranged to receive a cane assembly user's index finger, so as to provide a maximized tactile response area between the cane assembly and the user's hand. The digit finger of the user would mate deeply within the groove in a straight pointing manner so as to receive a full tactile response around as much of the user's finger as possible, from the solid tip of the cane, thus maximizing the intelligence received thereby. The second side of the handle engagement housing, would be an information or indicia zone wherein the user's name or phone number or like information may be printed or embossed.

In a preferred embodiment of the present invention, the elongated metal shaft is preferably made from graphite or aluminum, so as to provide strength and transmittability of sounds and vibrations.

The solid elliptically shaped or egg shaped plastic tip, may be pressfit or screwfit onto the distalmost end of the tapered metal shaft of the cane assembly. The solid tip is important to properly transmit the vibrations from the terrain against which it is tapped or rubbed.

Further embodiments of the cane assembly include several telescoping sections spaced between the handle engagement housing and the elliptically shaped distalmost shape thereon. The distal end of each particular cane section would be loosenable so as to telescopically receive or permit the elongation of the respective sections therefrom.

The invention thus comprises a cane assembly for the visually handicapped, to permit maximum tactile and auditory information between terrain touched by the cane assembly and a user thereof, comprising a cane shaft having an upper or proximalmost end and a lower or distalmost end. A handle is secured to the upper end of the shaft, and a solid elliptically shaped plastic tip is secured to the distalmost tip of the shaft, to permit the cane assembly to provide superior touch and sound from all terrain encountered, without the likelihood of snagging on a crack. The handle has a first side thereon, the first side having an elongated groove therein arranged for receipt of a user's finger for maximum finger/cane handle contact. The elliptically shaped plastic tip has a long axis with a bore therealong which mates with the distalmost end of the shaft. The handle has a second side thereon, the second side having a recess portion thereon for display of an indicia therewithin. The shaft is comprised of a plurality of sections telescopingly arranged with respect to one another, to enable the cane assembly to be foreshortened for storage. The shaft is hollow, and has a tapered external configuration, from the first end to the second end. The handle comprises a handle housing and a "J" shaped handle portion, the "J" shaped handle portion having a soft outer covering thereon, to permit ease of holding thereof.

The invention also includes a method of manufacturing a cane assembly for the visually handicapped, in order to provide a cane which permits maximum tactile and auditory information between terrain touched by the cane assembly and a user thereof, comprising the steps of: providing a cane shaft having an upper or proximalmost end and a lower or distalmost end; attaching a handle to the upper end of the shaft; and mating a solid elliptically shaped plastic tip secured to the distalmost tip of the shaft, to provide a simple cane construction which will permit the cane assembly to provide superior touch and sound from all terrain encountered, without the likelihood of snagging on a crack. The method of manufacturing a cane assembly includes the steps of drilling and tapping into the long axis of the elliptically shaped plastic tip, to permit the plastic to be screwed and unscrewed from the distal end of the shaft, and forming an elongated groove or channel into a side edge of the handle, to permit a user of the cane assembly to insert a finger therein, for maximum tactile feedback thereby.

BRIEF DESCRIPTION OF THE DRAWINGS

The objects and advantages of the present invention will become more apparent, when viewed in conjunction with the following drawings, in which:

FIG. 1 is a side elevational view of a cane assembly constructed according to the principles of the present invention;

FIG. 2 is an enlarged view of the J-shaped handle and the handle engagement housing of the cane of the present invention;

FIG. 3 is a view taken along the lines 3—3 of FIG. 2;

DESCRIPTION OF THE PREFERRED EMBODIMENTS

Figure 4:
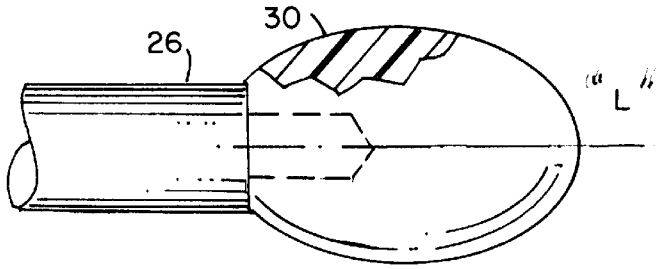
FIG. 4 is a side elevational view of the distal tip of the shaft and the elliptically shaped tip attached thereto, partly in section.

Referring now to the drawings in detail, and particularly to FIG. 1, there is shown the present invention which comprises a novel cane assembly 10 to be utilized by a visually handicapped individual. The cane assembly 10 comprises an upper or proximalmost end 12 having a curved or J-shaped handle 14, as may be seen more closely in FIG. 2. The end portion of the handle 14 is preferably a soft sponge covering 16 fitted onto a rigid metal, plastic or wood core. The J-shaped handle 14 includes a handle engagement housing 18. The handle engagement housing 18 has a lower or distalmost end 20 with a bore 22 therewithin, a cross-section of which is shown in FIG. 3. The bore 22 is arranged to receive the proximalmost end of a metal shaft 24, of tapering dimensions, the shaft 24 importantly becoming narrower at its distalmost end 26. The proximalmost end of the shaft (about 0.50 to about 0.75 inches in daimeter) mates within the bore 22 in the lower or distalmost end of the preferably metal handle engagement housing 18 in a tight fitting manner.

The distalmost end 26 of the tapered shaft 24, (of about 0.25 to about 0.47 inches in diameter) has an elliptically shaped (or egg shaped) solid plastic tip 30 mated thereon, in alignment with the long axis 31 of said elliptically shaped tip 30, as shown in FIG. 4. The taper of the shaft 24 is important because the vibrations are transmitted more properly through such a shaft. The elliptical (non-spherical) shape of the tip 30 is important because such an "elongated curved shape" provides a greater arc length (parallel to the long axis "L" of the elliptically shaped tip 30) of "terrain contact" than would a just a "round type" hemispherically or spherically shaped tip. This shape of the replaceable tip 30 is important for maximizing tactile feedback from the terrain touched, to the user.

The handle engagement housing 18 is elongated, preferably made from metal, and is of generally square-shape in cross-section, as shown in FIG. 3. The handle engagement housing 18 has a first side 32 with an elongated channel or U-shaped groove 34 arranged therein. The elongated handle engagement housing 18 has an opposing second side 36 with a shallow depression 38 therewithin.

The channel or groove 34 on the first side 32 of the handle engagement housing 18, as shown for a right handed user in FIG. 1, is arranged to receive a cane assembly user's index finger, so as to provide a maximized tactile response area between the cane assembly 10 and the user's hand. The digit finger of the user would mate deeply within the groove 34 in a straight pointing manner so as to receive a full tactile response around as much (for example: at least 180°) of the user's finger as possible, from the solid tip 30 of the cane 10, thus maximizing the intelligence received thereby. The second side 36 of the handle engagement housing 18, as may be seen in FIG. 2, would be an information or indicia zone 39 in the depression 38, wherein the user's name or phone number, reflector or like information may be printed or embossed.

In a preferred embodiment of the present invention, the elongated metal shaft 24 is preferably made from graphite or aluminum, so as to provide strength and superior transmittability of sounds and vibrations.

The solid elliptically shaped or egg shaped plastic tip 30, may be press-fit or screw-fit onto the distalmost end 26 of the tapered metal shaft 24 of the cane assembly 10, as shown in FIG. 4. The solid tip 30 is important to properly transmit the vibrations from the terrain against it is tapped or rubbed.

Figure 5:
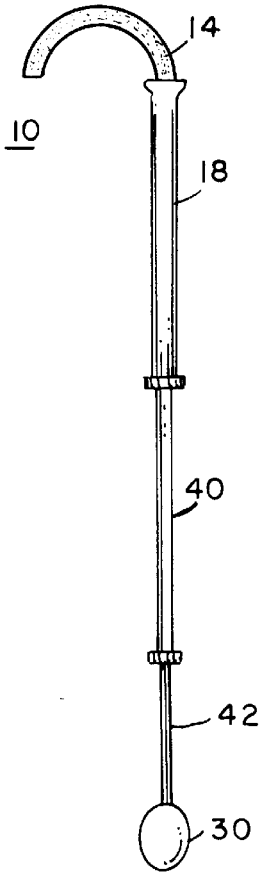
FIG. 5 is a side view of a cane assembly having collapsible and expandable telescoping sections therewith.
Figure 6:
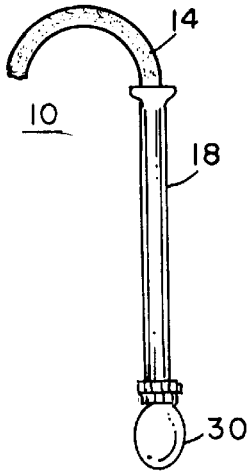
FIG. 6 is a side elevational view of the telescoping cane assembly shown in FIG. 5, in a collapsed or compact configuration.

Further embodiments of the cane assembly 10 include several telescoping sections 40 and 42 spaced between the handle engagement housing 18 and the elliptically shaped distalmost tip 30 thereon, as shown in FIGS. 5 and 6. The distal end of each particular cane section would be loosenable so as to telescopically receive or permit the elongation of the respective sections therefrom.

I claim:

1. A cane assembly for the visually handicapped, to permit maximum tactile and auditory information between terrain touched by said cane assembly and a user thereof, comprising:

a cane shaft having an upper end and a distalmost end;

a "J" shaped handle secured said upper end of said shaft;

a solid elliptically shaped plastic tip secured to said distalmost end of said shaft, to permit said cane assembly to provide superior touch and sound from all terrain encountered, without the likelihood of snagging on a crack; and wherein said handle has an elongate generally square shaped engagement housing and a "J"shaped handle portion, said engagement housing having a first side thereon, said first side having an elongated groove extending vertically therein arranged for receipt of a user's finger for maximum finger/cane handle contact.

2. The cane assembly for the visually handicapped, as recited in claim 1, wherein said elliptically shaped plastic tip has a long axis with a bore therealong which mates with said distalmost end of said shaft.

3. The cane assembly for the visually handicapped, as recited in claim 1, wherein said engagement housing handle has a second side thereon, said second side having a recess portion therein for display of an indicia therewithin.

4. The cane assembly for the visually handicapped, as recited in claim 1, wherein said shaft is comprised of a plurality of sections telescopingly arranged with respect to one another, to enable said cane assembly to be foreshortened for storage.

5. The cane assembly for the visually handicapped, as recited in claim 1, wherein said shaft is hollow, and has a tapered external configuration, from said upper end to said distalmost end.

6. The cane assembly for the visually handicapped, as recited in claim 1, wherein said "J" shaped handle portion having a soft outer covering thereon, to permit ease of holding thereof.

7. The cane assembly for the visually handicapped, as recited in claim 5, wherein said upper end of said shaft has a diameter selected from a range of about 0.50 to about 0.75 inches, and said distalmost end of said shaft has a diameter selected from a range of about 0.25 to about 0.47 inches.

8. The cane assembly for the visually handicapped, as recited in claim 6, wherein said handle portion thereof is made from a metal for proper tactile response to the user.

9. A method of manufacturing a cane assembly for the visually handicapped, to provide a cane which permits maximum tactile and auditory information between terrain touched by said cane assembly and a user thereof, comprising the steps of:

providing a cane shaft having an upper or proximalmost end and a lower or distalmost end;

providing a "J" shaped handle having an generally square shaped engagement housing and a "J" shaped handle portion;

attaching the "J" shaped handle to said upper end of said shaft;

mating a solid elliptically shaped plastic tip secured to said distalmost tip of said shaft, to provide a simple cane construction which will permit said cane assembly to provide superior touch and sound from all terrain encountered, without the likelihood of snagging on a crack; and forming an elongated groove or channel into a side edge said engagement housing of said handle, to permit a user of said cane assembly to insert a finger therein, for maximum tactile feedback thereby.

10. The method of manufacturing a cane assembly for the visually handicapped, as recited in claim 9, including the step of:

drilling and tapping into said long axis of said elliptically shaped plastic tip, to permit said plastic to be screwed and unscrewed from said distalmost end of sad shaft.

11. The method of manufacturing a cane assembly for the visually handicapped, as recited in claim 9, including the step of:

manufacturing said handle from a metal so as to provide optimum tactile response of said cane assembly from said tip to the user thereof.

12. The method of manufacturing cane assembly for the visually handicapped, as recited in claim 9, including the step of:

forming a taper onto said shaft from a wider diameter at its upper end to a narrower diameter at its distalmost end thereof.

* * * * *